United States Patent [19]

Kuchenbecker et al.

[11] 4,405,287

[45] Sep. 20, 1983

[54] REGULATING DEVICES FOR A PLURALITY OF PUMPS DRIVEN BY A COMMON SOURCE

[75] Inventors: Dietrich Kuchenbecker, Aschaffenburg; Erich Eckhardt, Grossumstadt, both of Fed. Rep. of Germany

[73] Assignee: Linde Aktiengesellschaft, Hollriegelskreuth, Fed. Rep. of Germany

[21] Appl. No.: 276,704

[22] Filed: Jun. 23, 1981

[30] Foreign Application Priority Data

Jun. 28, 1980 [DE] Fed. Rep. of Germany ..... 3024399

[51] Int. Cl.[3] ..... F04B 49/00

[52] U.S. Cl. ..... 417/216; 60/447; 60/452; 60/486; 417/218

[58] Field of Search ..... 417/216, 218-222, 417/53; 60/428, 486, 447, 449, 451, 452

[56] References Cited

U.S. PATENT DOCUMENTS 4,080,979 3/1978 Hein ..... 417/216 X 4,115,033 9/1978 Kleineisel et al. ..... 417/216

4,203,712 5/1980 Uehara ..... 60/452 X

FOREIGN PATENT DOCUMENTS 53-64802 6/1978 Japan ..... 417/216

*Primary Examiner*—Edward K. Look

*Attorney, Agent, or Firm*—Buell, Blenko, Ziesenheim & Beck

[57] ABSTRACT

A regulating device is provided for an aggregate of several pumps driven by a primary source at least one of which is adjustable and with a constant volume auxiliary control pressure pump driven by the same primary source in the delivery line of which a restrictor is located with the pressure gradient in front of and following the restrictor acting on the control pressures of an hydraulically regulated discharge valve in a drain line connected to the delivery line of the auxiliary pump, the drain line being connected in front of the restrictor, adjusting means connected to each adjustable pump and a control pressure line to which all adjusting means are connected, branching off from the drain line ahead of the discharge valve.

8 Claims, 3 Drawing Figures

REGULATING DEVICES FOR A PLURALITY OF PUMPS DRIVEN BY A COMMON SOURCE

This invention relates to regulating devices for a plurality of pumps driven by a common source and particularly to an output regulating device for an aggregate of several pumps driven by a common primary energy source, preferably an internal combustion engine, in particular a Diesel engine, at least one of which, preferably several, but not all, is adjustable relative to its stroke volume per revolution, in which case the regulating device also has an auxiliary control pressure pump driven by the same primary energy source and constant relative to delivery volume per revolution, in the delivery line of which an invariable or adjustable (perhaps as a function of the adjustment of the primary energy source) restrictor is located, in which case the gradient between the pressures in front of and beyond this restrictor impacts on the control pressure chambers of a hydraulically regulated discharge valve, which is incorporated in a drain line connected to the delivery line of the auxiliary control pressure pump, in which case the final control elements of the individual adjustable pumps are connected with a control piston capable of displacement in a control cylinder. If the pumps as a whole assume an excessively great output, for example because the delivery pressure of a pump increases, the torque received from the primary energy source becomes too great, with the result that the r.p.m. of the latter and thus the delivery stream of the auxiliary control pressure pump decrease. In the devices known to date the result of this was that the control pressure drops at the cylinders loaded by the auxiliary control pressure pump, with the result that the adjustable pumps are adjusted to a smaller delivery volume per revolution and thus a smaller torque received, so that the load on the primary energy source again drops. However, there is a considerable time lapse between the moment of increase in the power received and displacement of the control pistons; this also results in a tendency of such regulating devices to oscillate. The invention also concerns a regulating method to reduce or eliminate this oscillation.

The invention proposes to improve the regulating function of such a device and especially to avoid fluctuations, in which case the improvement can also be achieved by developing a method by which further improvements are possible.

According to the invention, it is provided for solving this problem that the drain line is connected to the delivery line of the auxiliary control pressure pump in front of the restrictor in the direction of flow and that a control pressure line, to which all the adjusting elements are connected, branches off from the drain line in front of the discharge valve, in which case the discharge valve is open during normal operation and closes with a drop in the pressure gradient at the restrictor corresponding to the degree of drop in the pressure gradient, with the result that the pressure rises in the control pressure line leading to the adjusting elements when the delivery stream of the auxiliary control pressure pump decreases. A considerably more sensitive and also more rapid response can thus be achieved than with the devices known to date. As a result, the fluctuations do not develop as readily as in the device known to date.

A regulating device of the type for a pump aggregate consisting of several pumps, in which the control cylinder or cylinders assigned to the adjustable pump or pumps are loaded by the delivery pressure of the assigned pumps, is already known also. In this familiar device the control cylinders connected with the final control elements of the individual pumps are loaded directly by the delivery pressure, while the cylinder loaded by the auxiliary control pressure pump is in operating connection through intermediate elements with the final control elements (DE-OS 26 03 563). A collaboration of the control pressure dependent on the r.p.m. of the primary energy source end of the delivery pressure with the regulating device is thus already known in this familiar device. Nevertheless, such a device also presents the danger of oscillation according to experience to date.

In order to solve the problem posed, it is provided in the regulating device according to the invention wherein one or more control cylinders is loaded by the pressure of one or more adjustable pumps each with a control piston that is in operating connection with an adjusting element of an adjustable pump that the control piston loaded by the control pressure influences the adjustment of the pressure-limiting valve connected with the control pressure line leading to the adjusting elements. In the case of several adjustable pumps the control pistons in the control cylinders act to a control plate supported against a spring, the which plate influences the setting of the said pressure-limiting valve. As a result, as in the originally known devices, the control cylinders for the individual pumps are loaded by the control pressure produced by the auxiliary control pressure pump, but this control pressure that influences the control cylinders is determined not only by the r.p.m. of the primary energy source, but also by the delivery pressure of the pumps, such that a quite rapid response is achieved when the sum of the powers received is exceeded in thus the tendency to oscillation is reduced. It should be taken into account here that the connection of a discharge valve to the delivery line (principle control pump line) emerging from the auxiliary control pressure pump is already known in itself (DE-OS 23 27 257). In the familiar device, which serves only to regulate a drive unit, this discharge valve is however actuated in direct dependence on the delivery pressure of the pumps and decreases the control pressure when it opens.

In the object of the present invention the power regulation characteristic curve can be modified overall or only in one section by selecting the appropriate spring characteristics of the high-pressure spring and/or the low-pressure spring at the pressure-limiting valve. Through selection of the spring stiffness, the behavior of the pressure in the control pressure line can be determined as a function of the delivery pressure. Due to the fact that either the pressure determined by the maximum-load valve or the pressure determined by the pressure-limiting valve acts in the control pressure line, a rapid delivery pressure-dependent intervention is achieved without basically cancelling or modifying the maximum load regulation characteristic, provided the delivery pressure-dependent intervention does not occur. Through an appropriate dimensioning of the high-pressure spring at the pressure-limiting valve, the intervention point of the delivery pressure-dependent signal is influenced and the point beyond which the maximum-load regulation is overtraveled is thus determined.

Overtraveling results in a more rapid processing of the delivery pressure-dependent signal and thus a stabilization of the regulation circuit. The maximum-load regulation known to date has the disadvantage that due to the lag in response the r.o.m. of the primary energy source is very sharply reduced or depressed before it is sufficiently back-regulated. This shortcoming is avoided through the overtraveling by the delivery pressure-dependent signal. A device according to the invention, which switches in the intervention of the delivery pressure-dependent signal, which can be gauged hydraulically or electrically/electronically, can be incorporated in addition to a maximum-load regulation provided by this invention.

In accordance with this invention the adjusting elements connected with the final control elements of the adjustable pumps each have a control cylinder with a control piston and have adjustable pistons, in which case the adjustable control pistons are loaded by the pressure in the control pressure line and act on a lever, which in turn is supported against a spring and acts on a pilot valve that controls the loading of the control piston. Such a structure can be highly advantageous because such adjusting elements furnish an advantageous control function at the control pressure available. On the other hand, the use of this design of the adjusting elements can be advantageous if the adjustable pumps are provided with such adjusting elements in mass production, as can be the case especially with adjustable pumps in swiveling slide construction. Such a design of the adjusting elements has already been proposed by the German patent application P 29 30 139.1. The problem posed is solved with the regulating method according to the invention. In the method known (through DE-OS 26 03 563) an r.p.m.-dependent signal and a signal dependent on the delivery pressure are superimposed and the signal resulting from this superposition influences the mutually coupled adjusting elements of the pumps, where the r.p.m.-dependent signal decreases with decreasing r.p.m. of the auxiliary control pressure pump. In contrast, a comparison is made between the two signals and the larger one influences the adjusting elements of the pump.

In the foregoing general description certain objects, advantages and purposes of this invention have been set out. Other objects, purposes and advantages of this invention will be apparent from a consideration of the following description and the accompanying drawings in which two embodiments of the invention are illustrated and wherein.

Figure 1:
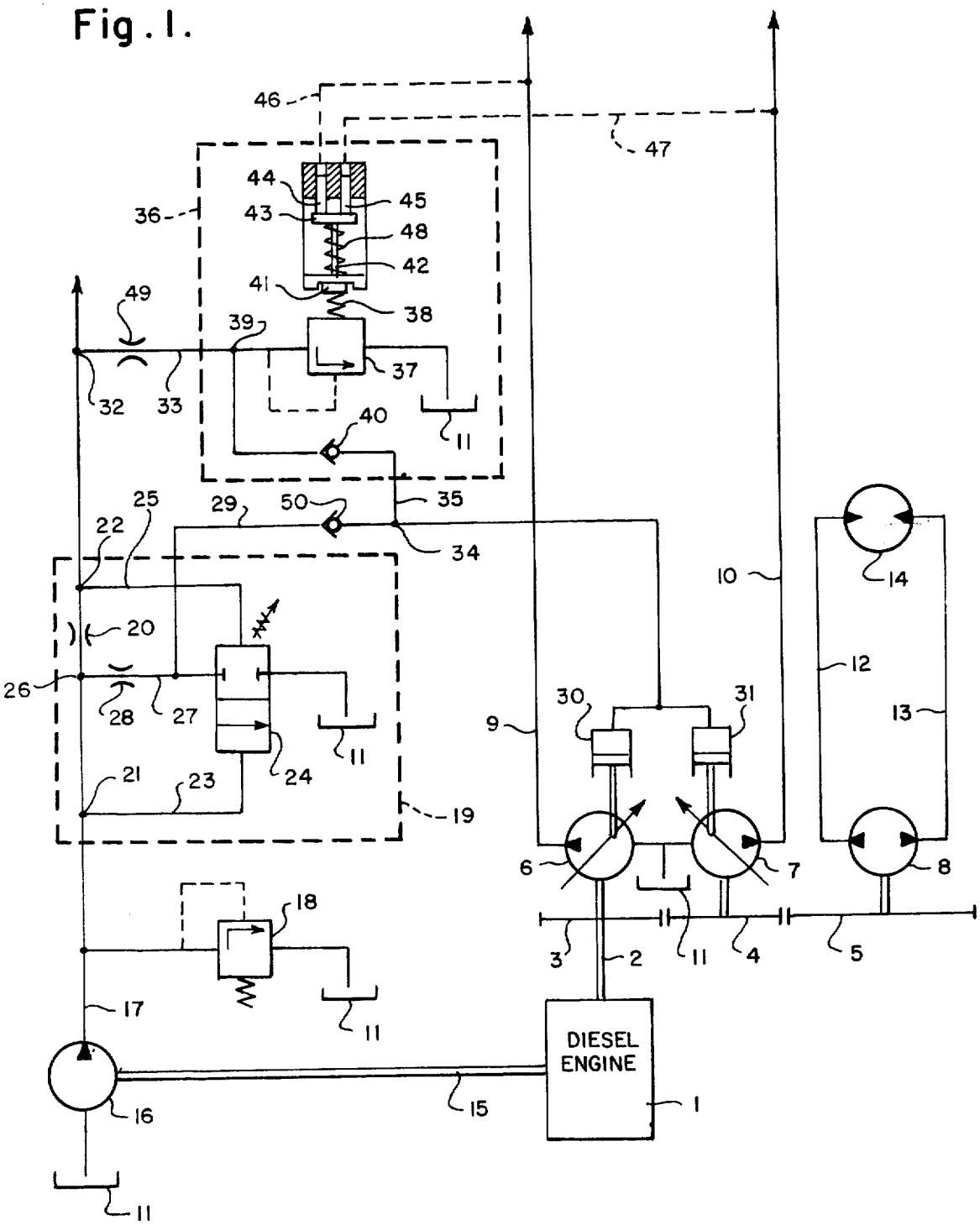
FIG. 1 shows a circuit diagram for one of the embodiments.

In the drawings there is illustrated a primary energy source in the form of a Diesel engine 1, which drives the gear train 3, 4, 5 through the shaft 2, from which the adjustable pumps 6 and 7 and the pump 8 are driven.

The pump 6 feeds into the feed line 9 and pump 7 feeds into the feed line 10. The two pumps 6 and 7 draw from the pressureless container 11. The pump 8 is connected through the lines 12 and 13 in closed circuit with the hydraulic motor 14. If the pump aggregate 6, 7, 8 constitutes a portion of the drive system of a dredge, for example, the hydraulic motor 14 can be for example the slewing gear motor. Pump 8 can (as symbolically shown) be an adjustable pump, but can also advantageously be a constant pump.

The components 2–14 are part of the main drive aggregate.

The Diesel engine 1 also drives the auxiliary control pressure pump 16 through a secondary shaft 15; this pump 16 also draws from the container 11 and its delivery stream per revolution is invariable. The auxiliary control pressure pump feeds into the principal control pump line 17, which is protected by a pressure-limiting valve 18 and leads to the maximum-load valve 19. In the latter a restrictor 20 is provided in the principal control pump line 17 for the purpose of retaining a pressure that is dependent on the delivery stream of the auxiliary control pressure pump 16 in the principal control pump line 17, or for the purpose of developing a pressure gradient that is dependent on the drive r.p.m. of the auxiliary control pressure pump 16 through this delivery stream at this restrictor 20. This pressure gradient is removed at the connection points 21 and 22, where the pressure in the principal control pump line 27 in front of the restrictor 20 is fed through the control pressure line 23 to one of the control pressure chambers of the discharge valve 24 and the pressure in the principal control pump line 17 beyond the restrictor 20 is fed through the line 25 to the other control pressure chamber of the discharge valve 24. In the case of a large pressure gradient between the branch sites 21 and 22 the discharge valve is opened, and it closes when the pressure gradient drops below a predetermined maximum value.

At a point in the direction of flow in front of the restrictor 20 a control pressure line 27 is connected to the principal control pump line 17 at a connection point 26 (which can also be identical with the connection point 21 or can branch off from line 23). This control pressure line 27 contains a constant restrictor 28 and leads to the discharge valve 24 and from it a control pressure line 29 branches off, which leads to the control cylinders 30 and 31 of the pumps 6 and 7, in which case a control piston is capable of displacement in each of the control cylinders 30 and 31. This control piston is connected with the final control element of the assigned pump.

The mode of operation is as follows: If the Diesel engine 1 runs at its prescribed r.p.m., the auxiliary control pressure pump 16 feeds a prescribed delivery stream into the principal control pump line 17 such that a prescribed pressure gradient develops at the restrictor 20, which holds the discharge valve 20 open. The control pressure line 19 is thus connected to the open discharge valve 24, while the constant restrictor 18 prevents the medium from flowing out of the principal control pump line 17 in a pressureless manner through the discharge valve 24. The control cylidners 30 and 31 are thus also pressureless and the pumps 6 and 7 are thus set at their position of maximum delivery volume per revolution.

If the r.p.m. of the Diesel engine 1 drops, the delivery stream of the auxiliary control pressure pump 16 decreases and thus the pressure gradient at the connection points 21 and 22, such that the discharge valve 24 begins to close and the pressure gradient in front of and beyond the constant restrictor 28 decreases with decreasing stream flowing off through the discharge valve 24, such that the pressure in the control pressure line 29 increases to the maximum to the pressure in the principal control pump line 17. An increasing pressure in the control pressure line 29 and thus in the control cylinders 30 and 31 has the result that the pumps 6 and 7 are adjusted to a smaller delivery volume per revolution. This in turn has the result that the power consumption of the pumps 6 and 7 and thus the load on the Diesel engine 1 decrease and consequently its r.p.m. again increases.

A branch line 33 is connected to the principal control pump line 17 beyond the restrictor 20 or beyond the maximum-load valve 19 at another connection point 32. A secondary line 35 is connected to the control pressure line 29 at a connection point 34. The branch line 33 and the secondary line 35 lead to a high-pressure modulation valve 36. In the latter a pressure-limiting valve 37 is connected to the line 33; its setting is determined by the pretensioning of the low-pressure spring 38. The secondary line 35 is connected to the secondary line 33 at the connection point 39. A check valve 40 is located in the secondary line 35.

The low pressure spring 38 is supported against a spring plate 41, which is rigidly connected through a rod 42 with the plate 43, against which the control pressure pistons 44 and 45 rest, in which case the control pressure piston 44 is loaded with pressure through the line 46 from the delivery line 9 and the control piston 45 is loaded with pressure through the line 47 from the delivery line 10. The plate 43 is supported against a high-pressure spring 48, which is also supported in the housing.

A restrictor 49 is also located in the line 33.

A check valve 50 is also advantageously located in the control pressure line 29 between the maximum-load valve 19 and the connection point 34 for the secondary line 35.

The mode of operation is as follows: If the sum of the delivery pressures in the feed lines 9 and 10 is so small that the sum of the forces exerted by the control pistons 44 and 45 on the control plate 43 is less than the force of the high-pressure spring 48, the pressure-limiting valve 37 is set at the lowest conceivable pressure. However, if the delivery pressure increases in at least one of the delivery lines 9 and 10, the plate 43 is shifted against the force of the high-pressure spring 48 and thus the pretensioning of the low-pressure spring 38 is increased, so that the pressure-limiting valve 37 is adjusted to a higher pressure. The pressure in the line 33 thus increases and also the pressure in the secondary line 35. If the pressure in the line 33 increases above the pressure in the control pressure line 29, the check valve 40 opens, with the result that the pressure prevailing in line 33 now also prevails in the control pressure line 29 and acts on the control cylinders 30 and 31. However, if the pressure determined by the maximum-load valve 19 should be higher than the set pressure of the pressure-limiting valve 37, the check valve 40 closes and the pressure in the control pressure line 29 is determined exclusively by the maximum-load valve 19.

Through the throttling effect on the regulating edge of the discharge valve 25 (and the constant throttle 28), a reactive effect of the pressure prevailing in the secondary line 35 is normally sufficiently avoided. However, as a precautionary measure the check valve 50 can be provided so that it is assured by means of the two check valves 40 and 50 that the higher one of the two pressures determined by the maximum-load valve 19 and the high-pressure modulation valve 36 prevails in the control pressure line 29 and acts on the control cylinders 30 and 31.

Of course, it is possible in another embodiment to provide another control piston besides the control pistons 44 and 45 parallel to them and to load the pump 8 with the delivery pressure through an addtional line that is connected through check valves to lines 12 and 13 such that the higher one of the pressures prevailing in these two lines acts in this additional line, such that the delivery pressure of this additional pump, together with the delivery pressures of pumps 6 and 7, also acts directly on the control pressure in the control pressure line 29, while in the circuitry shown in FIG. 1 the delivery pressure of pump 8 exerts an influence only through the power input in shaft 2. With an appropriate dimensioning of the individual pumps relative to each other, it can however suffice.

The maximum pressure that can develop in line 33 and thus in the secondary line 35 is determined by the additional low-pressure consumers (not shown in the drawing), to which the principal control pump line 17 leads beyond the connection point 32.

Figure 2:
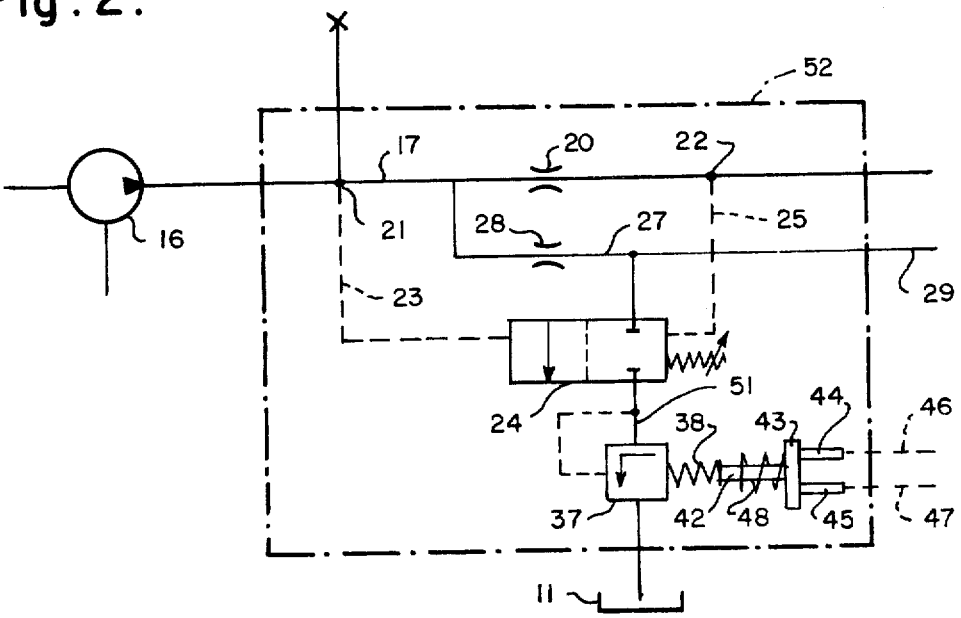
FIG. 2 shows a circuit diagram of a second embodiment in which a portion of the circuit diagram according to FIG. 1 is modified.

The design according to FIG. 2 differs from that according to FIG. 1 by the fact that the pressure-limiting valve 37 is connected differently. In the design according to FIG. 2 the line 51 is connected to the second connection of the discharge valve 24, which lies opposite the connection connected to the line 27, and the pressure-limiting valve 37 is connected in this line 51, while otherwise the components with the same reference numbers are the same as in FIG. 1.

The mode of operation is as follows: As already mentioned in connection with FIG. 1, the discharge valve 24 opens if the pressure gradient between the connection points 21 and 22 is sufficiently great. The pressure in the line 27 and thus in the line 29 is determined by the pressure-limiting valve 37 in the design according to FIG. 2 when the discharge valve 24 is open. If the valve 37 is in a free passage state, the control pressure line 29 is also pressureless. However, if the pressure-limiting valve 37 is adjusted to a higher pressure as a result of an increase in the sum of pressures in the lines 46 and 47, the pressure thus increases in the line 51 and is communicated through the discharge valve 24 to the line 27 and thus to the control pressure line 29 so that this higher pressure also acts on the control cylinders 30 and 31. However, if the pressure gradient between the connection points 21 and 22 decreases, the discharge valve 24 closes and induces through its closure the stagnation in front of the discharge valve 24 and thus in the line 27 and also in the control pressure line 29. If an increased pressure has already prevailed in the line 51 at the beginning of closure of the discharge valve 24 due to the setting of the pressure-limiting valve 37, this is superimposed on the throttling action in the closing discharge valve 24.

The components shown in the circuit diagram of FIG. 2, with the exception of the control pressure pump 16, are combined in a block 52.

Figure 3:
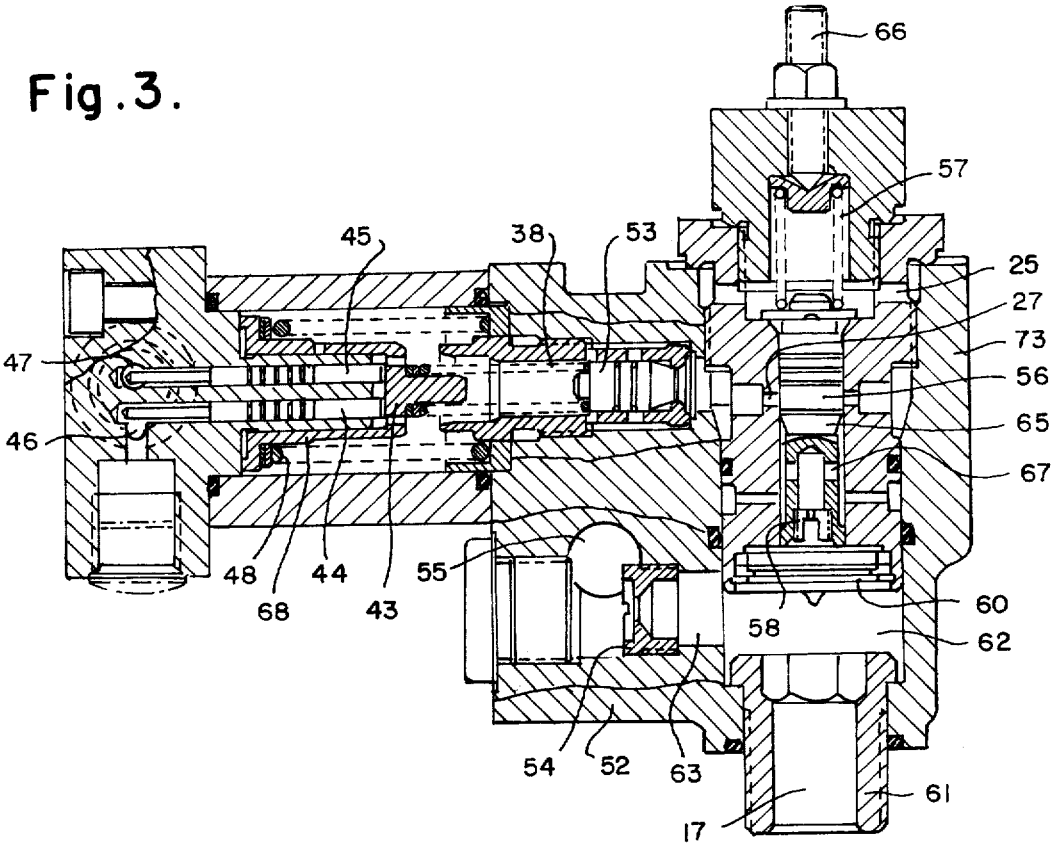
FIG. 3 shows a section through a regulating device according to circuit diagram of FIG. 2.

This block 52 is shown in FIG. 3 in cross section.

The principal control pump line 17 is connected through a connecting element 61 such that it leads to a chamber 62 in the section 73 of the overall housing 52. This chamber 62 contains a structural component 60, which contains a baffle plate that prevents the stream flowing axially through line 17 from exerting a dynamic action on the regulating piston 56. A secondary borehole 63 is connected to the chamber 62; this borehole 63 contains a component 54 which has a borehole that represents the restrictor 20, beyond which the drain line 55 branches off and leads to the additional low-pressure consumers (not shown nor treated).

A structural component 58 is screwed into the regulating piston 56; it contains a narrower borehole, which forms the restrictor 28. The control or operating piston 56 is supported against a spring, which holds the regulating piston 56 in its closed position if the pressure gradient between the pressure in the space 62 and the pressure in the line 25 is too low. If the pressure gradient is sufficient, the regulating piston 56 is displaced so far upward in FIG. 3 that the regulating conical section 65 lies in front of the mouth of line 27. In its extreme upward position the regulating piston 56 lies against the carrying bolt 66 so that the transverse boreholes 67 in the regulating piston 56 lie in front of the mouths of line 27. This is the normal operating position.

The regulating piston 53 of the pressure-limiting valve is supported against the low-pressure spring 38, which in turn is supported against the intermediate plate 43, against which the control pistons 44 and 45 rest and which is connected with a pot-like component 68, on the left flange of which in the drawing the high-pressure spring 48 is supported. The components in FIG. 3 with a vertical axis thus constitute the discharge valve 24, while the pressure-limiting valve 37 is depicted with a horizontal axis.

In the foregoing specification certain preferred embodiments and practices of this invention have been set out; however, it will be understood that this invention may be otherwise practiced within the scope of the following claims.

We claim:

1. In a regulating device for an aggregate of several pumps driven by a common primary-energy source, at least one of which pumps is adjustable relative to its output volume per revolution, and with an auxiliary control pressure pump constant with respect to output volume per revolution and driven by the same primary-energy source, in the delivery line of which a restrictor is located, a hydraulically regulated discharge valve having at least one control pressure chamber in which case the pressure gradient in front of and beyond this restrictor acts on the at least one control pressure chambers of said hydraulically regulated discharge valve, which discharge valve is incorporated in a drain line connected to the delivery line of the auxiliary control pressure pump, the improvement wherein the drain line is connected in front of the restrictor in the direction of flow to the delivery line from the auxiliary control pressure pump, adjusting means connected to each adjustable pump and a control pressure line, to which all the adjusting means connected to each adjustable pump are connected, branching off from the said drain line in front of the discharge valve.

2. Regulating device according to claim 1 wherein a control cylinder is connected to and loaded by the delivery pressure of the adjustable pumps each cylinder having a control piston that is hydraulically connected to the adjusting means of the adjustable pumps, a pressure-limiting valve forming a part of said hydraulic connection, a resilient connection between said pressure limiting valve and the control piston whereby said pressure limiting valve is regulated by the position of the control piston loaded by the delivery pressure of the adjustable pumps, and a connection from said limiting valve to the control pressure line leading to the adjusting means and also to a line connected to the delivery line from the auxiliary control pressure pump.

3. Regulating device according to claim 2, wherein the control pistons in the control cylinders are supported on a control plate, a high-pressure spring acting on said pistons, a resilient connection between said plate and the pressure limiting valve to charge the adjustment of the pressure-limiting valve connected with the control pressure line.

4. Regulating device according to claim 2, wherein a line leading to the pressure-limiting valve is the drain line of the discharge valve.

5. Regulating device according to claim 2, wherein a line leading to the pressure-limiting valve and connected to a pressure medium source is connected to the delivery line of the auxiliary control pressure pump, beyond the restrictor in front of additional consumers and a secondary line containing a check valve opening toward the control pressure line and connected to the control pressure line is connected to said line leading to the pressure-limiting valve and that a restrictor is located between the delivery line from the auxiliary pump and the pressure-limiting valve.

6. Regulating device according to claim 5, wherein a check valve opening toward the adjusting means is locted in the control pressure line between its connection to the line leading to the discharge valve and the connection point of the secondary line.

7. Regulating device as in any of the preceding claims, characterized in that the adjusting elements connected with the final control elements of the adjustable pumps each have a control cylinder with a control piston and have adjustable control pistons, in which case the adjustable control pistons are loaded by the pressure in the control pressure line and act on a lever, which in turn is supported against a spring and acts on a pilot valve that controls tha loading of the control piston.

8. Regulting deice according to claim 1 or 2 or 3 or 4 or 5 or 6 wherein the discharge valve and the pressure-limiting valve with the control pistons regulating their adjustment are located in a common block.

* * * * *